US008315074B2

(12) United States Patent
Zhu

(10) Patent No.: US 8,315,074 B2
(45) Date of Patent: Nov. 20, 2012

(54) CMOS BANDGAP REFERENCE SOURCE CIRCUIT WITH LOW FLICKER NOISES

(75) Inventor: Guojun Zhu, Chengdu (CN)

(73) Assignee: IPGoal Microelectronics (Sichuan) Co., Ltd., High-Tech Incubation Park, Chengdu, Sichuan Province (CN)

( * ) Notice: Subject to any disclaimer, the term of this patent is extended or adjusted under 35 U.S.C. 154(b) by 316 days.

(21) Appl. No.: 12/831,147

(22) Filed: Jul. 6, 2010

(65) Prior Publication Data

US 2011/0043184 A1 Feb. 24, 2011

(30) Foreign Application Priority Data

Aug. 20, 2009 (CN) ..... 2009 1 0164205

(51) Int. Cl.
*G05F 3/08* (2006.01)
*G05F 3/20* (2006.01)

(52) U.S. Cl. ..... 363/49; 363/50; 323/901; 323/313; 323/314; 327/538; 327/539

(58) Field of Classification Search ..... 363/49, 363/50; 323/901, 313, 314; 327/538, 539
See application file for complete search history.

(56) References Cited

U.S. PATENT DOCUMENTS

| | | | | |
|---|---|---|---|---|
| 5,867,013 | A * | 2/1999 | Yu | 323/314 |
| 5,955,873 | A * | 9/1999 | Maccarrone et al. | 323/314 |
| 6,242,898 | B1 * | 6/2001 | Shimizu et al. | 323/313 |
| 7,288,925 | B2 * | 10/2007 | Nagata | 323/313 |
| 7,852,061 | B2 * | 12/2010 | Liu et al. | 323/313 |
| 8,138,743 | B2 * | 3/2012 | Ide | 323/313 |
| 2008/0231248 | A1 * | 9/2008 | Hung | 323/313 |
| 2010/0164466 | A1 * | 7/2010 | Jo | 323/313 |
| 2010/0164467 | A1 * | 7/2010 | Jo | 323/313 |
| 2010/0308789 | A1 * | 12/2010 | Beck et al. | 323/313 |

* cited by examiner

*Primary Examiner* — Bao Q Vu

(57) ABSTRACT

The present abstract discloses a CMOS bandgap reference source circuit, comprising a startup circuit, a power-off control circuit, a reference voltage generating circuit and an operational amplifier. The positive and a negative input terminal of the operational amplifier both consist of two same field effect transistors and both are provided with an input controlled switch; by doing so, two field effect transistors in the positive terminal and two field effect transistors in the negative terminal work alternately between their strong inversion and cut-off region so as to drastically reduce the noises of the reference circuit, which results originally from the flicker noises of two input transistors of the operational amplifier.

14 Claims, 5 Drawing Sheets

CMOS BANDGAP REFERENCE SOURCE CIRCUIT WITH LOW FLICKER NOISES

BACKGROUND OF THE PRESENT INVENTION

1. Field of Invention

The present invention relates to the field of analog integrated circuits and mixed signals integrated circuits, particularly, to a CMOS bandgap reference source circuit with low flicker noises.

2. Brief Description of Related Arts

Bandgap reference source circuit is an important part of the analog integrated circuit and is widely applied to various analog and mixed signal integrated circuits, such as switching power supply (DC-DC), linear regulator, digital-analog converting circuits (ADC&DAC) and so on, which all need a reference voltage without changing along with the power supply and temperature. Among various reference circuits, the bandgap reference source circuit has better temperature characteristic and power supply rejection ratio (PSRR), is not subject to manufacturing techniques, and accordingly becomes the first option for designing the reference circuit.

For some system circuits requiring a reference voltage with high accuracy, a CMOS bandgap reference source circuit with low noises is necessary. Two main noise sources with the CMOS bandgap reference result from the flicker noises of field effect transistors (FET) and thermo-noise of all components in circuits. Generally speaking, the flicker noises of FET is inversely proportional to the frequency. When the frequency is about dozens of KHz, the flicker noise becomes the main noise source of the CMOS bandgap reference circuit. Consequently, bigger flicker noises have limited the application of the CMOS bandgap reference circuit. For example, the high performance audio DAC circuit working at the range of 20 Hz to 20 KHz really needs a low noise reference circuit to ensure the performance of the converting circuit.

FIG. 1 shows a conventional CMOS bandgap reference source circuit with the following operational principle. The circuit adopts the feedback control of the operational amplifier to make the voltage of node N1 and N2 the same value, thereby the current flowing through resistor R1 is equal to $\Delta V_{be}/R_1$, where $\Delta V_{be}$ is the difference of $V_{be0}$ minus $V_{be1}$. FET MP1, MP2 and MP3 compose a current mirror. Since the gate-source voltages of the three FET are the same and three of them all work at saturation regions, their drain-source currents are approximately the same. Therefore, the output of the reference circuit is $$V_{ref} = V_{be2} + \frac{R_2}{R_1}\Delta V_{be}.$$

In the equation, $V_{be2}$ is negative temperature coefficient and $\Delta V_{be}$ is positive coefficient, so that the output voltage with a zero temperature coefficient can be attained by setting up the ratio of R2 and R1.

For the CMOS bandgap reference source circuit shown in FIG. 1, when operating at the audio range, the two input transistors MP8 and MP9 generate flicker noises that become the main noise source. There are a couple of conventional ways to reduce the flicker noises.

(1) increase components area to reduce flicker noises

According to the definition for flicker noises, the noise density of flicker noises is given by the following formula:

$$V_n^2 = \frac{K}{C_{ox} * W * L} * \frac{1}{f},$$

wherein K is a constant with the order of magnitude of $10^{-25}$ $V^2F$, not subject to manufacturing techniques; Cox is capacitance of gate oxide per unit area; f is operating frequency; W is the width of FET; L is the length of FET. It can be seen from the formula that flicker noise is inversely proportional to frequency. The smaller the frequency, the bigger the noises. In addition, flicker noise is proportional to the area (W*L) of the FET, therefore, the easiest way to reduce flicker noise is just to expand the area of components. However, this way has led to bigger chips areas, especially when a system requires a reference voltage with lower flicker noises. For instance, suppose there is a ADC with SNR of 100 dB and the voltage of output signals is 1V. To achieve 100 dB SNR, the total maximum noise is 10 uV; therefore, the noise resulting from reference source must be less than 10 uV. To generate that little noise, each of components in the circuit has to expand their areas close to one thousand of square micron.

(2) utilize CHOP structure to average flicker noises

CHOP structure is used to make the flicker noise be equivalent to an offset voltage of a reference circuit, to switch periodically two input terminals and two output terminals of the operational amplifier, to average the power spectrum of the flicker noises in a certain frequency range, and then to achieve a reference voltage output with lower noises through a lowpass filter. However, because the lowpass filter is implemented through resistors and capacitors inside of the chips, it would also cause bigger chips area.

(3) by way of special manufacturing techniques

U.S. Pat. No. 6,514,825, U.S. Pat. No. 6,160,274, U.S. Pat. No. 6,653,679 all use special manufacturing techniques to manufacture FET with low flicker noise. Nevertheless, these methods are relatively complicated, don't fit the mainstream standard of CMOS technology and have increased manufacturing cost as well.

SUMMARY OF THE PRESENT INVENTION

The object of the present invention is to furnish a CMOS bandgap reference source circuit with low flicker noise, which uses two overlapping clocks to control the gate of the input FETs of the operational amplifier of the reference circuit, makes the FETs switch alternately between their strong inversion and cut-off regions; consequently, it can effectively reduce the flicker noises resulting from the FETS, cut down the cost, and dispense with special manufacturing techniques.

According to embodiments of the present invention, the CMOS bandgap reference source circuit with low flicker noises comprises a startup circuit; power-off control circuit; an operational amplifier and a reference voltage generating circuit. The startup circuit is for preventing the reference circuit from working in the erroneous zero currents status; the power-off control circuit is to control whether or not each of branch currents is turned off; the operational amplifier is for adjusting the voltage which is generated from the reference voltage generating circuit and raising the power supply rejection ratio of reference circuit; the reference voltage generating circuit is for outputing final reference voltage.

Various implementations may include one or more of the following advantages. For example, both the positive and the negative input terminal of the operational amplifier are consisting of two same field effect transistors, and both are provided with an input control switch. By controlling the input control switch, the two FETs in the positive input terminal and two FETs in the negative input terminal work alternately between their strong inversion and cut-off regions, whereby FETs generate very little flicker noises, in turn, the flicker noises resulting from two sets of input transistors of the operational amplifier are reduced drastically.

These and other objectives, features, and advantages of the present invention will become apparent from the following detailed description, the accompanying drawings, and the appended claims.

DETAILED DESCRIPTION OF THE PREFERRED EMBODIMENT

Figure 1:
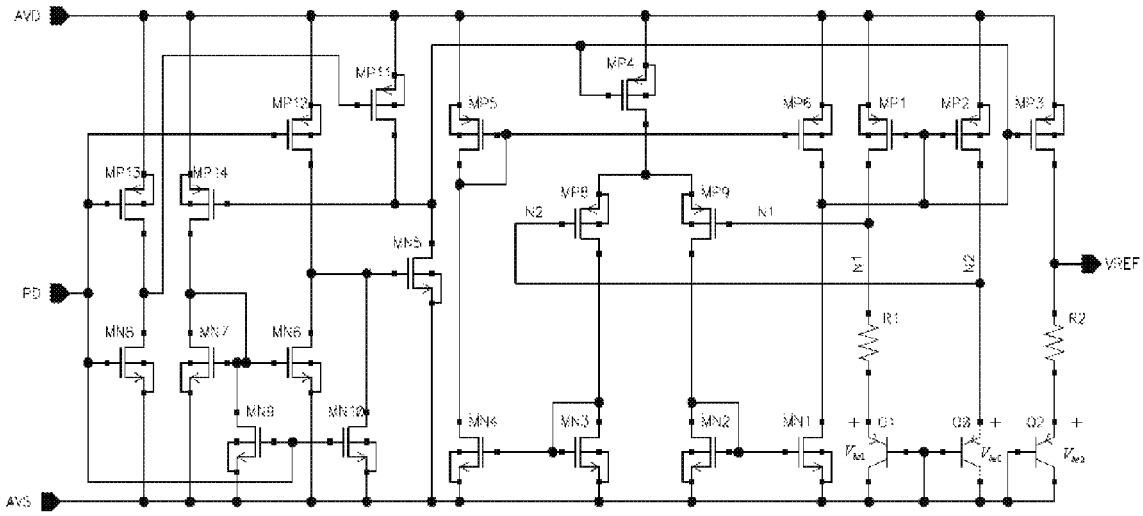
FIG. 1 shows a conventional bandgap reference circuit.
Figure 2:
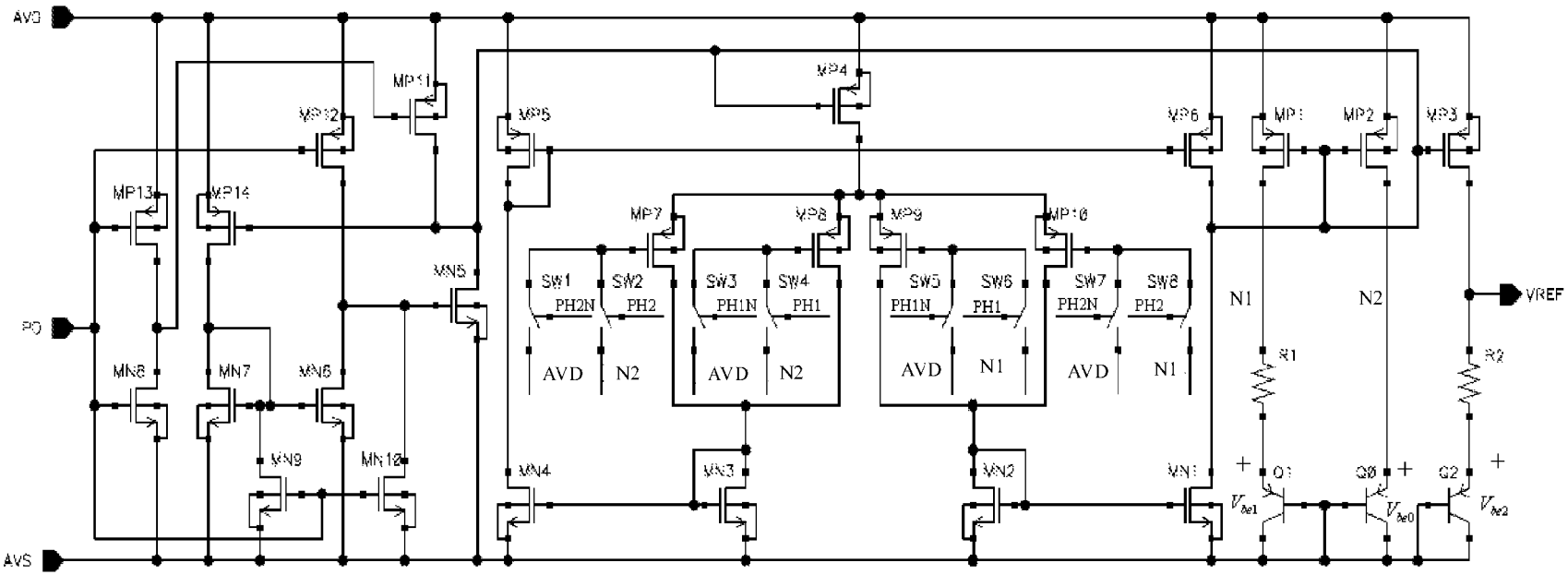
FIG. 2 is a circuit diagram of the present invention.

Referring to FIG. 2, a CMOS bandgap reference source circuit with low flicker noises of the present invention comprises a startup circuit, a power-off control circuit, an operational amplifier and a reference voltage generating circuit.

Both the positive and the negative input terminal of the operational amplifier are consisting of two same field effect transistors and both are provided with an input controlled switch. By controlling the input controlled switch, the two FETs in the positive input terminal and two FETs in the negative input terminal work alternately between their strong inversion and cut-off regions, whereby FETs generate very little flicker noises, in turn, the flicker noises resulting from two sets of input transistors of the operational amplifier are reduced drastically.

Said startup circuit comprises of five field effect transistors MP12, MP14, MN5, MN6 and MN7, wherein the width/length ratio of MN6 is far bigger than MN12's. The sources of MP12 and MP14 are connected with power supply; the gate of MP12 is connected with power-off signal PD; the drain of MP12, the gate of MN5 and the drain of MN6 are connected together; the drain of MP14, the drain of MN7, the gate of MN7 are connected with the gate of MN6; the source of MN5, the source of MN6 and the source of MN7 are all grounded.

The operating principle of the startup circuit is as follows: when the power supply is turned on, the gate of MP12 is a low level, which means that MP12 is turned on, therefore, the gate voltage of MN5 follows the power voltage. When the power voltage is more than the turn-on voltage of MN5, then MN5 is turned on, and the bias voltage of the current mirror in the reference circuit is drawn down to low lever, so that each branch of the circuit has currents flowing through, and the circuit gets into a normal working status from the zero current error status. Once getting into normal working, MN6 is able to obtain currents through the mirro-image relation with MN7; also because MN6 is designed with much bigger width/length ratio than MP12, the gate of MN5 is drawn down by MN6 to low level; finally, the startup process is finished.

Said power-off control circuit comprises of five field effect transistors, MP11, MP13, MN8, MN9 and MN10. When power-off signal PD is a high level, the power-off control circuit turns off every branch current of the reference circuit, so that there is no any power consumption. The gates of MN9, MN10 and MP13 are connected with power-off signal PD; the drains of MP13 and MN8 connected with the gate of MP11; the sources of MP11 and MP13 are connected with the power supply; the drain of MP11 is connected with the drain of MN5; the sources of MN8, MN9 and MN10 are grounded; the drain of MN10 is connected with the gate of MN5; the drain of MN9 is connected with the gate of MN7.

Said power-off control circuit is controlled by power-off signal PD. Its operating principle is as follows: when PD is a high level, the gate of MP11 is a low level, so the offset voltage of the current mirror of the reference circuit is raised by MP11 to a high level, and in turn all branch currents in the reference circuit are shut down; when PD is a low level, MP11 is turned off, and the reference circuit is in a normal working state.

The operational amplifier comprises of eleven field effect transistors, MN1, MN2, MN3, MN4, MP4, MP5, MP6, MP7, MP8, MP9 and MP10. MP7 and MP8 constitute the negative input terminal of the amplifier; MP9 and MP10 constitute the positive input terminal of the amplifier; MP4 operates as the current source of the amplifier; MN1, MN2, MN3, MN4, MN5 and MN6 constitute the load output of the current mirror of the amplifier to supply outputs to the amplifier. The sources of MP4, MP5 and MP6 are connected with a power supply; the gate of MP4 is connected with the drain of MN5; the drain of MP4 and the sources of MP7, MP8, MP9 and MP10 are connected together; the drain of MN4, the gate of MP5, the drain of MP5 and the gate of MP6 are connected together; the sources of MN4, MN3, MN2 and MN1 are grounded; the source of MN4, the source of MN3, the drain of MN3, the drain of MP7 and the drain of MP8 are connected together; the drains of MP9, MP10, MN2 and the gates of MN2 and MN1 are connected together; the drain of MN1 is connected with the drain of MP6.

A voltage controlled switch can be used as the input controlled switch of the operational amplifier, such as P-type or N-type EFT. Current controlled switches can also be employed, such as bipolar transistors.

Specifically, the input controlled switch of the amplifier comprises of eight switches SW1, SW2, SW3, SW4, SW5, SW6, SW7 and SW8, which are able to control the working state of the input FETs of the amplifier. The two terminals of SW1 are respectively connected with the gate of MP7 and the power supply; the two terminals of SW2 are respectively connected with the gate of MP7 and the drain of MP2; the two terminals of SW3 are respectively connected with the gate of MP8 and the power supply; the two terminals of SW4 are respectively connect with the gate of MP8 and the drain of MP2; the two terminals of SW5 are respectively connected with the gate of MP9 and the power supply; the two terminals of SW6 are respectively connected with the gate of MP9 and the drain of MP1; the two terminals of SW7 are respectively connected with the gate of MP10 and the power supply; the two terminals of SW8 are respectively connected with the gate of MP10 and the drain of MP1.

All of input controlled switches are connected with two-phase overlapping clock controlled signals, "PH1 and PH2" as well as "PH1N and PH2N", wherein PH1N is the phase reversal of PH1 and PH2N is the phase reversal of PH2; PH1, PH1N, PH2 and PH2N is alternately connected to the input controlled switch.

Said signal PH2N is connected to switch SW1; signal PH2 is connected to switch SW2; Signal PH1N is connected to switch SW3; signal PH1 is connected to switch SW4; Signal PH1 is connected to switch SW6; signal PH2N is connected to switch SW7; signal PH2 is connected to switch SW8.

When PH1 is a low level and PH2 is a high level, MP8 and MP9, as the input FETs of the amplifier, work at their strong inversion region, whereas MP7 and MP10 work at their cut-off region, with their gates connected with the power supply. When PH1 is a high level and PH2 is a low level, MP7 and MP10 work at their strong inversion region, whereas MP8 and MP9 work at their cut-off region, with their gates connected with the power supply. Consequently, MP7, MP8, MP9 and MP10 work periodically between their strong inversion and cut-off region, which makes FET generate little flicker noises.

Said reference voltage generating circuit comprises of resistors, R1 and R2, field effect transistors, MP1, MP2 and MP3, as well as bipolar transistors, Q0, Q1 and Q2, thereby generating a reference voltage output irrelevant to temperature and power supply. MP1, MP2 and MP3 constitute a current mirror, with their sources connected to a power supply; the gates of MP1, MP2 and MP3 are connected with the drain of MP6; the two terminals of resistor R1 are respectively connected with the drain of MP1 and the emitter of bipolar transistor Q1; the drain of MP2 and the emitter of Q0 are connected together; the two terminals of resistor R2 are respectively connected with the drain of MP3 and the emitter of bipolar transistor Q3; the base and collector of bipolar transistor Q0, the base and collector of Q1 as well as the collector and base of Q2 are all grounded.

The operating principle of said reference voltage generating circuit is as follows: when the drain voltages of MP1 and MP2 become the same by way of the feedback control of said amplifier, currents flowing through resistor R1 will be $\Delta V_{be}/R_1$, wherein $\Delta V_{be}=V_{be0}-V_{be1}$; since the gate-source voltages of MP1, MP2 and MP3 are the same and the three FETs all work at their saturation region, their drain currents are approximately the same, therefore the output of the reference circuit is $$V_{ref} = V_{be2} + \frac{R_2}{R_1}\Delta V_{be}$$

wherein $V_{be2}$ is negative temperature coefficient, $\Delta V_{be}$ is positive temperature coefficient, and correspondingly it can be done to obtain the output voltage under a zero temperature coefficient by determining the ratio of R2 to R1.

Figure 3:
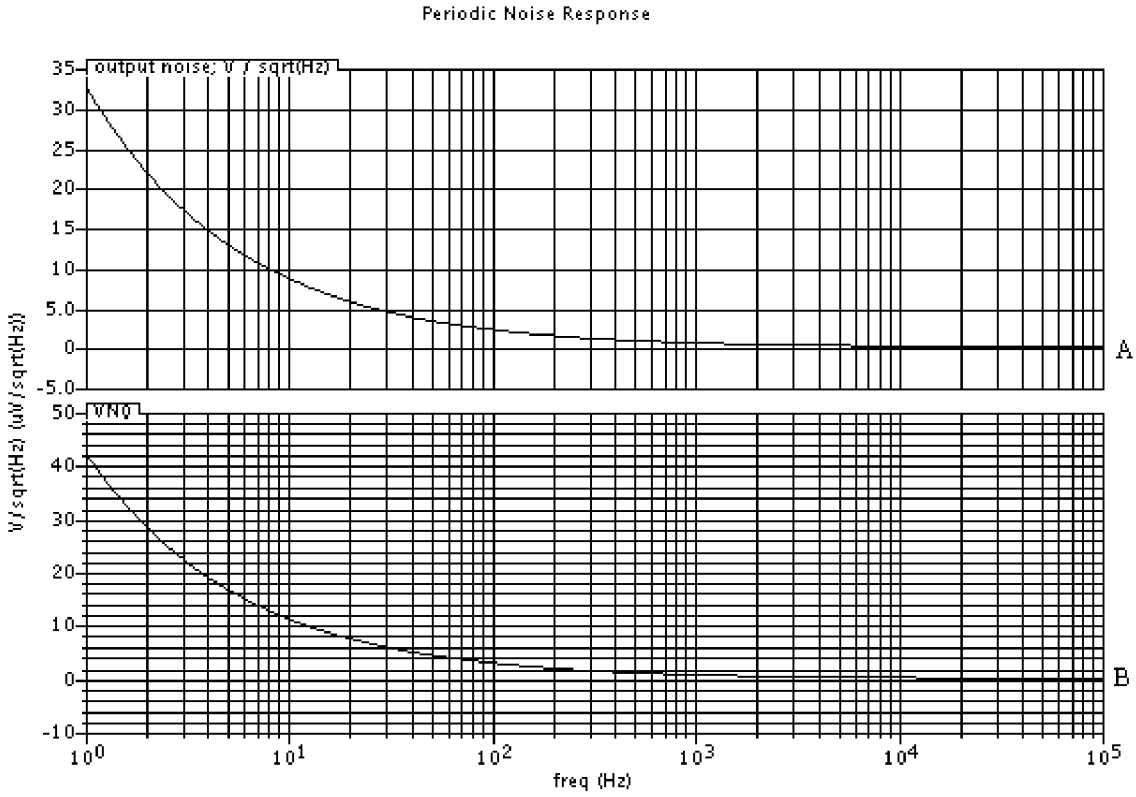
FIG. 3 shows a comparison diagram of simulated noise waveform of the present invention and the conventional one.

As shown in FIG. 3, curve A represents the simulated noise waveform of the present invention, and curve B represents the conventional one's, both having the same area of FET.

Figure 4:
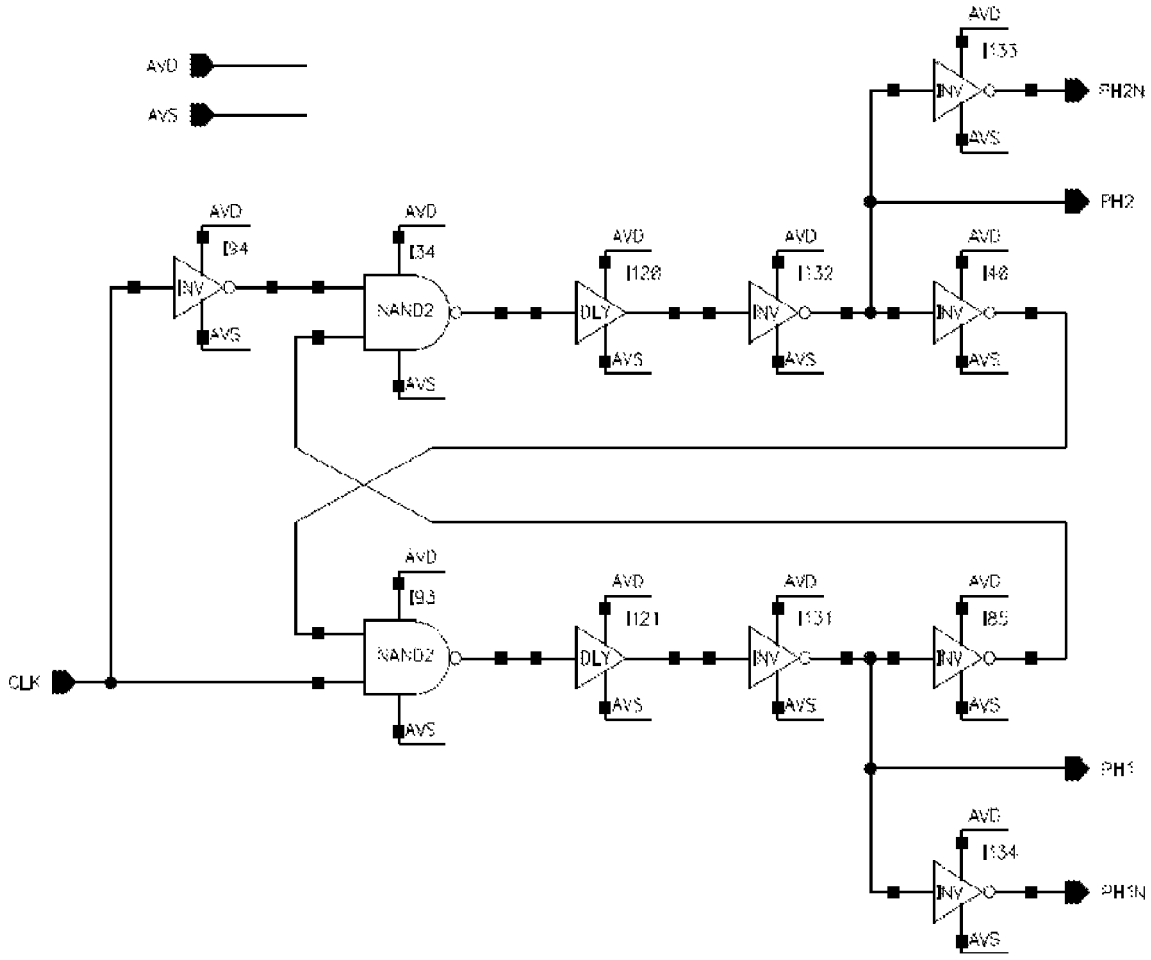
FIG. 4 is an electric schematic diagram of two-phase overlapping clock generating circuit.

FIG. 4 illustrates how to prevent MP7, MP8, MP9, MP10 from working simultaneously in their cut-off region, in other words, when switch SW2 is off, SW4 is still not on. In addition, because two inputs of the operational amplifier are connected with the power supply, open-loop is caused in the entire reference circuit and this further gives rise to reference voltage jump. To solve the problem, FIG. 4 has overlapped the two-phase clock in FIG. 2 and has formed a overlapping clock generating circuit, wherein two groups of FETs, MP7 and MP8 as well as MP9 and MP10, all have a short period of time working in their strong inversion region, so that the reference voltage jump is avoided.

Figure 5:
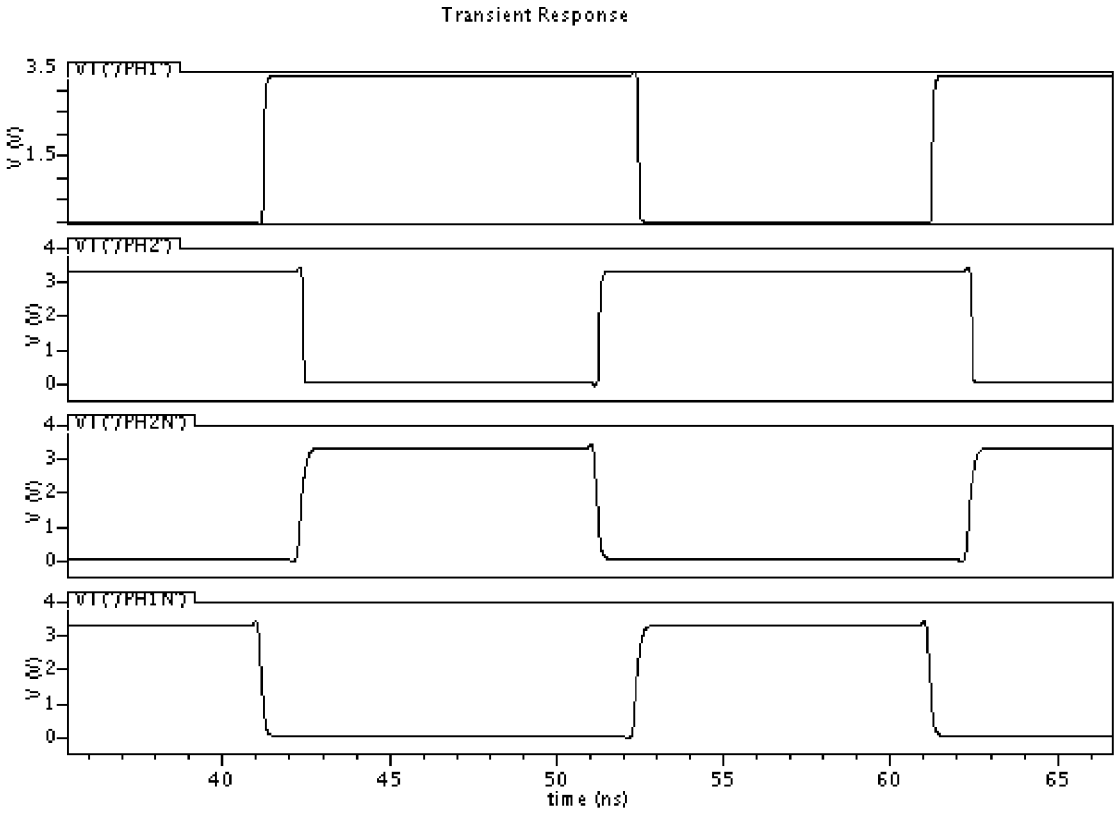
FIG. 5 shows a simulated noise waveform diagram of the two-phase overlapping clock generating circuit

FIG. 5 shows a simulation waveform of a two-phase overlapping clock generating circuit. As seen in the waveform, PH1 and PH2 have some time being simultaneously at a high level status, but never being at a low level status at the same time, which makes the two group of FETs, MP7 and MP8 as well as MP9 and MP10, have some time being turned on simultaneously, but never being turned off simultaneously, which is for meeting the design demand.

One skilled in the art will understand that the embodiments of the present invention as shown in the drawings and described above is exemplary only and not intended to be limiting.

It will thus be seen that the objects of the present invention have been fully and effectively accomplished. Its embodiments have been shown and described for the purpose of illustrating the functional and structural principles of the present invention and is subject to change without departure from such principles. Therefore, this invention includes all modifications encompassed within the spirit and scope of the following claims.

What is claimed is:

1. A CMOS bandgap reference source circuit with low flicker noise, comprising:
- a startup circuit to prevent the reference circuit from working in an erroneous zero current status;
- a power-off control circuit to control whether or not each of branch currents is turned off;
- a reference voltage generating circuit to output final reference voltage; and
- an operational amplifier to adjust the voltage generated from the reference voltage generating circuit,
- wherein a positive and a negative input terminal of the operational amplifier both consist of two same field effect transistors and both are provided with an input controlled switch, thereby two field effect transistors in the positive terminal and two field effect transistors in the negative terminal working alternately between their strong inversion and cut-off region.

2. The bandgap reference source circuit set forth in claim 1, wherein said startup circuit comprises five field effect transistors MP12, MP14, MN5, MN6 and MN7,
- wherein a width/length ratio of MN6 is bigger than MN12's;
  - sources of MP12 and MP14 are connected with a power supply;
  - the gate of MP12 is connected with a power-off signal PD;
  - the drain of MP12, the gate of MN5 and the drain of MN6 are connected together;
  - the drain of MP14, the drain of MN7, the gate of MN7 are connected with the gate of MN6; and
  - the source of MN5, the source of MN6 and the source of MN7 are all grounded.

3. The bandgap reference source circuit set forth in claim 2, wherein
- when the power supply is turned on, the gate of MP12 is a low level, MP12 is turned on, and in turn the gate voltage of MN5 follows the voltage of the power supply;
- when the voltage of the power supply is more than a turn-on voltage of MN5, then MN5 is turned on, the offset voltage of the current mirror in the reference circuit is drawn down to a low lever, and then each branch of the circuit has currents flowing through, and the circuit gets into a normal working status from the erroneous zero current status;
- once getting into normal working, MN6 is able to obtain currents through the mirro-image relation with MN7;
- also because MN6 has much bigger width/length ratio than MP12, the gate of MN5 is drawn down by MN6 to a low level;
- finally, the startup process is finished.

4. The bandgap reference source circuit set forth in claim 1, wherein the power-off control circuit comprises five field effect transistors, MP11, MP13, MN8, MN9 and MN10; when a power-off signal PD is a high level, the power-off control circuit turns off every branch current of the reference circuit, so that there is no any power consumption, wherein the gates of MN9, MN10 and MP13 are connected with the power-off signal PD;

the drains of MP13 and MN8 connected with the gate of MP11;

the sources of MP11 and MP13 are connected with a power supply;

the drain of MP11 is connected with the drain of MN5;

the sources of MN8, MN9 and MN10 are grounded;

the drain of MN10 is connected with the gate of MN5;

the drain of MN9 is connected with the gate of MN7.

5. The bandgap reference source circuit set forth in claim 4, wherein the power-off signal PD controls the power-off control circuit;

when PD is a high level, the gate of MP11 is a low level, so the offset voltage of the current mirror of the reference circuit is raised by MP11 to a high level, and hence all branch currents in the reference circuit are shut down;

when PD is a low level, MP11 is turned off, and the reference circuit is in a normal working state.

6. The bandgap reference source circuit set forth in claim 1, wherein the operational amplifier comprises eleven field effect transistors, MN1, MN2, MN3, MN4, MP4, MP5, MP6, MP7, MP8, MP9 and MP10, MP7 and MP8 constituting a negative input terminal of the amplifier, MP9 and MP10 constituting a positive input terminal of the amplifier, MP4 operating as a current source of the amplifier, and MN1, MN2, MN3, MN4, MN5 as well as MN6 constituting the output stage of the amplifier, wherein the sources of MP4, MP5 and MP6 are connected with a power supply;

the gate of MP4 is connected with the drain of MN5;

the drain of MP4 and the sources of MP7, MP8, MP9 and MP10 are connected together;

the drain of MN4, the gate of MP5, the drain of MP5 and the gate of MP6 are connected together;

the sources of MN4, MN3, MN2 and MN1 are grounded;

the source of MN4, the source of MN3, the drain of MN3, the drain of MP7 and the drain of MP8 are connected together;

the drains of MP9, MP10, MN2 and the gates of MN2 and MN1 are connected together;

the drain of MN1 is connected with the drain of MP6.

7. The bandgap reference source circuit set forth in claim 1, wherein the input controlled switch of the amplifier comprises eight switches SW1, SW2, SW3, SW4, SW5, SW6, SW7 and SW8, wherein two terminals of SW1 are respectively connected with the gate of MP7 and the power supply;

two terminals of SW2 are respectively connected with the gate of MP7 and the drain of MP2;

two terminals of SW3 are respectively connected with the gate of MP8 and the power supply;

two terminals of SW4 are respectively connect with the gate of MP8 and the drain of MP2;

two terminals of SW5 are respectively connected with the gate of MP9 and a power supply;

two terminals of SW6 are respectively connected with the gate of MP9 and the drain of MP1;

two terminals of SW7 are respectively connected with the gate of MP10 and the power supply;

two terminals of SW8 are respectively connected with the gate of MP10 and the drain of MP1.

8. The bandgap reference source circuit set forth in claim 7, wherein the input controlled switch is connected with two-phase overlapping clock controlled signals, "PH1 and PH2" as well as "PH1N and PH2N", wherein PH1N is the phase reversal of PH1 and PH2N is the phase reversal of PH2; PH1, PH1N, PH2 and PH2N is alternately connected to the input controlled switch.

9. The bandgap reference source circuit set forth in claim 8, wherein signal PH2N is connected to switch SW1; signal PH2 is connected to switch SW2; Signal PH1N is connected to switch SW3; signal PH1 is connected to switch SW4; Signal PH1 is connected to switch SW6; signal PH2N is connected to switch SW7; signal PH2 is connected to switch SW8.

10. The bandgap reference source circuit set forth in claim 9, wherein when PH1 is a low level and PH2 is a high level, MP8 and MP9, as the input FETs of the amplifier, work at their strong inversion region, whereas MP7 and MP10 work at their cut-off region, with their gates connected with the power supply;

when PH1 is a high level and PH2 is a low level, MP7 and MP10 work at their strong inversion region, whereas MP8 and MP9 work at their cut-off region, with their gates connected with the power supply;

therefore, MP7, MP8, MP9 and MP10 work periodically between their strong inversion and cut-off region.

11. The bandgap reference source circuit set forth in claim 1, wherein the reference voltage generating circuit comprises resistors, R1 and R2, field effect transistors, MP1, MP2 and MP3, as well as bipolar transistors, Q0, Q1 and Q2, thereby generating a reference voltage output irrelevant to temperature and power supply, wherein MP1, MP2 and MP3 constitute a current mirror, with their sources connected to the power supply;

the gates of MP1, MP2 and MP3 are connected with the drain of MP6;

two terminals of resistor R1 are respectively connected with the drain of MP1 and the emitter of bipolar transistor Q1;

the drain of MP2 and the emitter of Q0 are connected together;

two terminals of resistor R2 are respectively connected with the drain of MP3 and the emitter of bipolar transistor Q3;

the base and collector of bipolar transistor Q0, the base and collector of Q1 as well as the collector and base of Q2 are all grounded.

12. The bandgap reference source circuit set forth in claim 11, wherein by way of feedback control of said amplifier, the drain voltages of MP1 and MP2 obtain the same value, accordingly, currents flowing through resistor R1 are $\Delta V_{be}/R_1$, $\Delta V_{be}=V_{be0}-V_{be1}$;

because the gate-source voltages of MP1, MP2 and MP3 are the same and the three FETs all work at their saturation region, their drain currents are approximately the same, thus the output of the reference circuit is $$V_{ref} = V_{be2} + \frac{R_2}{R_1}\Delta V_{be},$$

wherein $V_{be2}$ is a negative temperature coefficient, $\Delta V_{be}$ is a positive temperature coefficient;

by predetermining the ratio of R2 to R1, the output voltage under a zero temperature coefficient can be obtained.

13. The bandgap reference source circuit set forth in claim 1, wherein the input controlled switch of the operational amplifier is a voltage controlled switch.

14. The bandgap reference source circuit set forth in claim 1, wherein the input controlled switch of the operational amplifier is a current controlled switch.

* * * * *